US006977470B2

(12) United States Patent
Tseng

(10) Patent No.: US 6,977,470 B2
(45) Date of Patent: Dec. 20, 2005

(54) CURRENT-DRIVEN OLED PIXEL

(75) Inventor: Jung-Chun Tseng, Pingtung County (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 10/833,143

(22) Filed: Apr. 28, 2004

(65) Prior Publication Data

US 2005/0242744 A1 Nov. 3, 2005

(51) Int. Cl.[7] ..... G09G 3/10
(52) U.S. Cl. ..... 315/169.3; 315/169.1; 345/76; 345/80
(58) Field of Search ..... 315/169.3, 169.4, 315/169.1; 345/76, 77, 82, 84, 55, 80

(56) References Cited

U.S. PATENT DOCUMENTS 6,373,454 B1 4/2002 Knapp et al. ..... 315/169.3
6,501,466 B1 12/2002 Yamagishi et al. ..... 345/82
6,753,654 B2 * 6/2004 Koyama ..... 345/76
6,841,948 B2 * 1/2005 Yoshida ..... 315/169.3
2004/0004443 A1 * 1/2004 Park et al. ..... 315/169.1

* cited by examiner

*Primary Examiner*—Wilson Lee
*Assistant Examiner*—Ephrem Alemu
(74) *Attorney, Agent, or Firm*—Thomas, Kayden, Horstemeyer & Risley

(57) ABSTRACT

A pixel device of an electroluminescence device that comprises a scan line and a data line corresponding to the pixel device, a voltage signal transmitted over the scan line having a first state and a second state, a current mirror circuit further comprising a first transistor including a gate, and a second transistor including a gate coupled to the gate of the first transistor, a first current flowing through the first transistor to the data line being provided in response to the first state of the voltage signal, a second current proportional to the first current flowing through the second transistor in response to the first state of the voltage signal, a light emitting diode connected to the second transistor, and a capacitor being charged to a voltage level in response to the first state of the voltage signal by the first current, and maintaining the second current during the second state of the voltage signal.

16 Claims, 2 Drawing Sheets

CURRENT-DRIVEN OLED PIXEL

FIELD OF THE INVENTION

This invention relates in general to an electroluminescence device and, more particularly, to a pixel element of an organic electroluminescence device.

BACKGROUND OF THE INVENTION

An electroluminescence ("EL") device is a device which makes use of the phenomenon of electro luminescence to emit light. An EL device generally includes thin film transistors ("TFT") and a light-emitting diode ("LED") further including a light-emitting layer. If the light-emitting layer contains organic light-emitting material, the device is referred to as an organic EL device. When a current passes between a cathode and an anode of the LED device, light is emitted through the light-emitting layer.

Typically, EL devices may be classified into voltage-driven and current-driven types. As compared to a current-driven EL device, a voltage-driven EL device may be disadvantageous in non-uniform pixel brightness caused by different threshold voltages and mobility of TFTs. Examples of current-driven EL devices are found in U.S. Pat. No. 6,373,454 to Knapp, entitled "Active Matrix Electroluminescence Devices, and U.S. Pat. No. 6,501,466 to Yamagishi, entitled "Active Matrix Type Display Apparatus and Drive Circuit Thereof."

For current-driven EL devices, the magnitude of a current flowing through an LED determines the gray scale or brightness of a pixel. As an example of a 6-bit gray-scale spectrum, if the maximum gray-scale current is 2.5 $\mu$A (microampere), the minimum gray-scale current is approximately 0.04 ($=2.5/[2^6-1]$) $\mu$A. Data line loading, that is, the resistance and parasitic capacitance of a data line corresponding to the pixel, may adversely affect smaller gray-scale currents. For example, if the parasitic capacitor is not charged or discharged to a stable state when a corresponding scan line is turned off, a poor pixel display may result. It is thus desirable to have a current-driven EL device that provides reliable gray-scale display and uniform brightness, especially in smaller gray-scale regions.

SUMMARY OF THE INVENTION

To achieve these and other advantages, and in accordance with the purpose of the invention as embodied and broadly described, there is provided a pixel device of an electroluminescence device that comprises a scan line and a data line corresponding to the pixel device, a voltage signal transmitted over the scan line having a first state and a second state, a current mirror circuit further comprising a first transistor including a gate, and a second transistor including a gate coupled to the gate of the first transistor, a first current flowing through the first transistor to the data line being provided in response to the first state of the voltage signal, a second current proportional to the first current flowing through the second transistor in response to the first state of the voltage signal, a light emitting diode connected to the second transistor, and a capacitor being charged to a voltage level in response to the first state of the voltage signal by the first current, and maintaining the second current during the second state of the voltage signal.

In one aspect, the pixel device further comprises a reset circuit for resetting the light emitting diode.

Also in accordance with the present invention, there is provided an electroluminescence device that comprises a plurality of scan lines, a plurality of data lines, and an array of pixels, each of the pixels being disposed near an intersection of one of the scan lines and one of the data lines further comprising a voltage signal transmitted over a corresponding scan line having a first state and a second state, a current mirror circuit further comprising a first transistor including a gate, and a second transistor including a gate coupled to the gate of the first transistor, a first current flowing through the first transistor to a corresponding data line being provided in response to the first state of the voltage signal, a second current proportional to the first current flowing through the second transistor in response to the first state of the voltage signal, a light emitting diode connected to the second transistor, and a capacitor being charged to a voltage level in response to the first state of the voltage signal by the first current, and maintaining the second current during the second state of the voltage signal.

In one aspect, each of the pixels further comprises a transistor including a gate coupled to a preceding scan line, a first terminal coupled to one end of the light emitting diode, and a second terminal coupled to the other end of the light emitting diode.

Still in accordance with the present invention, there is provided a method of operating an electroluminescence device that comprises providing a plurality of scan lines, providing a plurality of data lines, providing an array of pixels, each of the pixels being disposed near an intersection of one of the scan lines and one of the data lines, transmitting a voltage signal over a scan line corresponding to one of the pixel having a first state and a second state, providing a current mirror circuit comprising a first transistor further comprising a gate, and a second transistor further comprising a gate coupled to the gate of the first transistor, flowing a first current through the first transistor to a data line corresponding to the one pixel in response to the first state of the voltage signal, flowing a second current proportional to the first current through the second transistor in response to the first state of the voltage signal, connecting a light emitting diode to the second transistor, charging a capacitor in response to the first state of the voltage signal by the first current, and maintaining the second current during the second state of the voltage signal.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
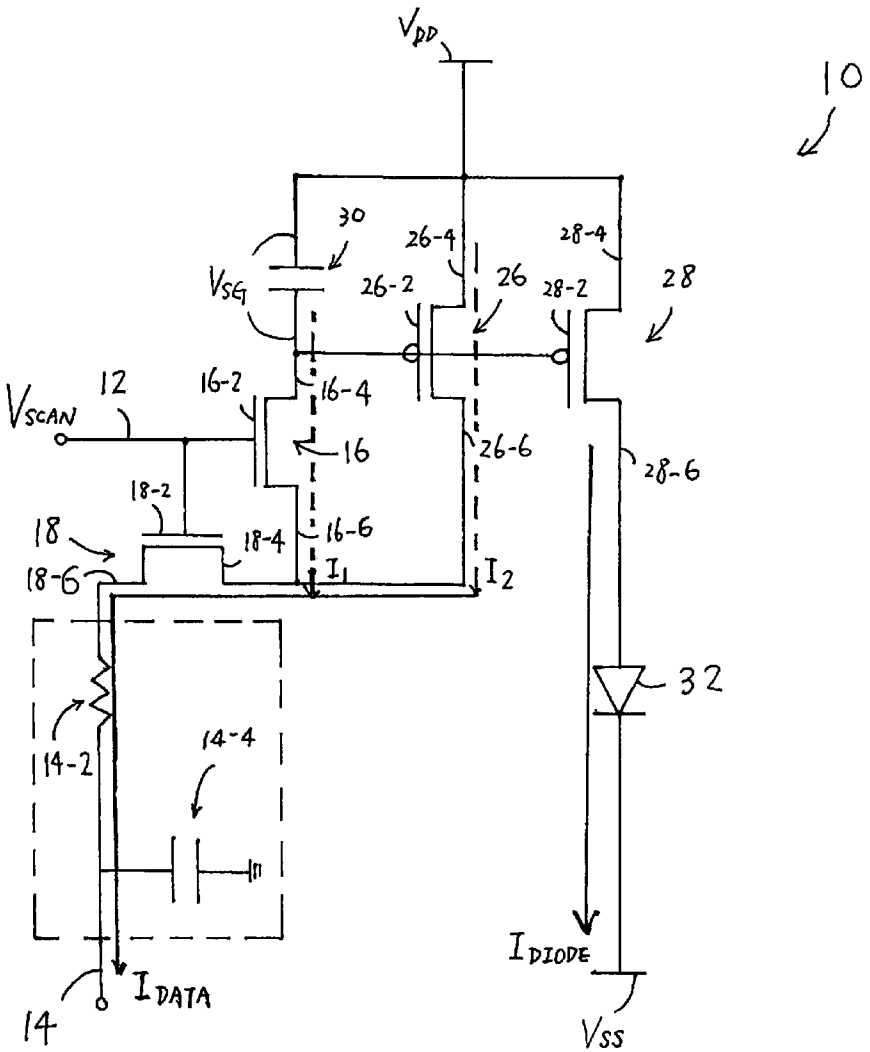
FIG. 1 is a circuit diagram of a pixel of an electroluminescence device in accordance with one embodiment of the present invention.

FIG. 1 is a circuit diagram of a pixel 10 of an electroluminescence ("EL") device in accordance with one embodiment of the present invention. The EL device consistent with the present invention includes a plurality of scan lines, a plurality of data lines, and an array of pixels formed in rows and columns. The EL device may further include a scan driver (not shown) sequentially providing a voltage signal to select the scan lines, and a data driver (not shown) sequentially providing a current signal to the data lines. Typically, each row of the pixels is scanned by the scan driver in a frame time. A frame time refers to a period during which all of the rows are scanned. In one embodiment according to the invention, the EL device includes an organic EL device, which may further include an organic light emitting diode ("OLED") or a polymer light emitting diode ("PLED"). A difference between an OLED and a PLED lies in the size of light emitting molecules used in a light emitting layer. The light emitting molecules of an OLED are smaller than those of a PLED.

Each of the pixels is disposed near an intersection of one of the scan lines and one of the data lines. Referring to FIG. 1, a representative pixel 10, disposed near a corresponding scan line 12 and a corresponding data line 14, includes a first switch transistor 16, a second switch transistor 18, a current mirror circuit (not numbered) further comprising a first transistor 26 and a second transistor 28, a capacitor 30, and a light emitting diode ("LED") 32. A voltage signal $V_{SCAN}$ provided by a scan driver (not shown) is transmitted over scan line 12. The voltage signal $V_{SCAN}$ includes a first state and a second state, for example, a logic high and a logic low states, respectively. Data line 14 includes a data line loading (shown in broken-line block) further comprising a resistor 14-2 and a parasitic capacitor 14-4. The data line loading may be 1 KΩ (kilo ohms) and 10 pF (pico farads) for 1.5-inch panels, and 2 KΩ and 20 pF for 2-inch panels.

First switch transistor 16 includes a gate 16-2, a first terminal 16-4 and a second terminal 16-6. Gate 16-2 receives the voltage signal $V_{SCAN}$. First terminal 16-4 is coupled to one end (not numbered) of capacitor 30. Second switch transistor 18 includes a gate 18-2, a first terminal 18-4 and a second terminal 18-6. Gate 18-2 receives the voltage signal $V_{SCAN}$ and is coupled to gate 16-2 of first switch transistor 16. First terminal 18-4 is coupled to second terminal 16-6 of first switch transistor 16-6. Second terminal 18-6 is coupled to data line 14. First transistor 26 of the current mirror circuit includes a gate 26-2, a first terminal 26-4 and a second terminal 26-6. Gate 26-2 is coupled to first terminal 16-4 of first switch transistor 16 and the one end of capacitor 30. First terminal 26-4 is coupled to the other end (not numbered) of capacitor 30 and a first power supply $V_1$. Second terminal 26-6 is coupled to first terminal 18-4 of second switch transistor 18 and second terminal 16-6 of first switch transistor 16. Second transistor 28 of the current mirror circuit includes a gate 28-2, a first terminal 284 and a second terminal 28-6. Gate 28-2 is coupled to first terminal 16-4 of first switch transistor 16 and gate 26-2 of first transistor 26 of the current mirror circuit. First terminal 28-4 is coupled to first power supply $V_{DD}$. LED 32 includes an anode (not numbered) coupled to second terminal 28-6 of the current mirror circuit, and a cathode (not numbered) coupled to a second power supply $V_{SS}$.

First transistor 26 has a channel width/length ratio N times that of second transistor 28. In one embodiment according to the invention, N is approximately 10. First power supply $V_{DD}$ provides a voltage level ranging from approximately 7V (volts) to 9V, second power supply $V_{SS}$ provides a voltage level ranging from approximately −8V to −6V. The voltage signal $V_{SCAN}$ ranges from approximately −6V to 8V.

During a writing stage, or in response to the first state of the voltage signal $V_{SCAN}$ provided over scan line 12, first switch transistor 16 and second switch transistor 18 are turned on. First transistor 26 and second transistor 28 are also turned on. A first current $I_{DATA}$ flows from pixel 10 to data line 14. The data driver of the EL device consistent with the invention that provides first current $I_{DATA}$ functions to serve as a current sink. Capacitor 30 is charged by first power supply $V_{DD}$ until a voltage level $V_{SG}$ across capacitor 30 is reached. The voltage level $V_{SG}$ satisfies the following equation:

$$I_{DATA}=(\mu C_{OX}/2)(W/L)(|V_{SG}|-|V_T|)^2$$

where p is the mobility of carriers, $C_{OX}$ is oxide capacitance, W/L is the channel width/length of first transistor 26, and VT is a threshold voltage of first transistor 26.

In the beginning, first current $I_{DATA}$ is contributed by currents $I_1$ and $I_2$ (both shown in broken lines). When the voltage level $V_{SG}$ is reached, current $I_1$ (shown in broken lines) becomes zero, and current $I_2$ is equal to first current $I_{DATA}$. As a result, a stable first current $I_{DATA}$ flows through first transistor 26, second switch transistor 18 to data line 14. In the meantime, a second current $I_{DIODE}$ flows through second transistor 28 and LED 32 to second power supply $V_{SS}$. Since the W/L ratio of first transistor 26 is N times that of second transistor 28, second current $I_{DIODE}$ is equal to approximately 1/N $I_{DATA}$. In one embodiment according to the invention, first current $I_{DATA}$ ranges from approximately N times 0.04 μA (microampere) to N times 2.5 μA.

During a reproducing stage, or in response to the second state of the voltage signal $V_{SCAN}$, first and second switch transistors 16 and 18 are turned off, which in turn cuts off first current $I_{DATA}$. Capacitor 30, which has been charged to the voltage level $V_{SG}$, maintains second current $I_{DIODE}$ which would otherwise be cut off with first current $I_{DATA}$. In other words, during the second state of the voltage signal $V_{SCAN}$, the voltage level $V_{SG}$ supports second current $I_{DIODE}$ flowing through LED 32.

For pixel 10 shown in FIG. 1, first and second switch transistors 16 and 18 are n-channel metal-oxide-semiconductor ("NMOS") transistors, and first and second transistors 26 and 28 of the current mirror circuit are p-channel metal-oxide-semiconductor ("PMOS") transistors. In other embodiments, however, transistors 16 and 18 may include PMOS transistors. In still other embodiments, transistors 26 and 28 are NMOS transistors.

Figure 2:
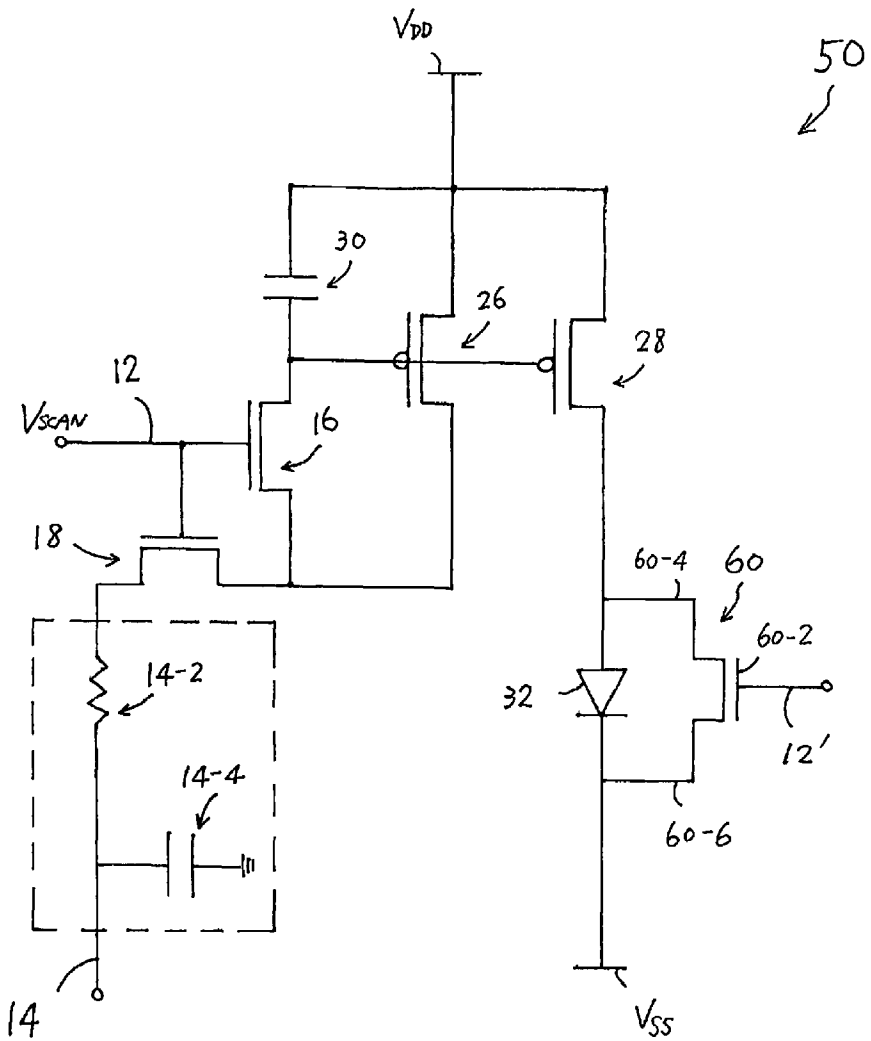
FIG. 2 is a circuit diagram of a pixel of an electroluminescence device in accordance with another embodiment of the present invention.

FIG. 2 is a circuit diagram of a pixel 50 of an electroluminescence ("EL") device in accordance with another embodiment of the present invention. Pixel 50 has a similar circuit structure to pixel 10 shown in FIG. 1 except that a reset circuit (not numbered) is included. The reset circuit is provided across LED 32 to reset LED 32 which may otherwise be adversely affected by parasitic capacitance. The reset circuit includes a transistor 60 further comprising a gate 60-2, a first terminal 604 and a second terminal 60-6. Gate 60-2 receives a voltage signal provided over a preceding scan line 12'. First terminal 60-4 and second terminal 60-6 are coupled to the anode and cathode of LED 32, respectively. When scan line 12' is selected, transistor 60 is turned on to conduct residual current in LED 32 to second power supply $V_{SS}$. Since scan line 12 is immediately selected after scan line 12', pixel 50 is optimized in terms of its writing and reproducing capabilities.

The present invention also provides a method of operating an electroluminescence device. A plurality of scan lines and data lines are provided. An array of pixels is provided. Each of the pixels is disposed near an intersection of one of the scan lines and one of the data lines. A voltage signal $V_{SCAN}$ having a first state and a second state is transmitted over a scan line 12 corresponding to one of the pixels. A current mirror circuit comprising a first transistor 26 and a second transistor 28 is provided. First transistor 26 includes a gate 26-2 coupled to a gate 28-2 of second transistor 28. A first current $I_{DATA}$ flows through first transistor 26 to a data line 14 corresponding to the one pixel 10 in response to the first state of the voltage signal $V_{SCAN}$. A second current $I_{DIODE}$ proportional to first current $I_{DATA}$ flows through second transistor 28 in response to the first state of the voltage signal $V_{SCAN}$. A light emitting diode ("LED") 32 is connected to second transistor 28. A capacitor 30 is charged to a voltage level $V_{SG}$ in response to the first state of the voltage signal $V_{SCAN}$ by first current $I_{DATA}$ Second current $I_{DIODE}$ is maintained during the second state of the voltage signal $V_{SCAN}$ by the voltage level $V_{SG}$ of capacitor 30.

In one embodiment according to the invention, first transistor 26 has a W/L ratio N times that of second transistor 28. In another embodiment, a first switch transistor 16 and a second switch transistor 18 are provided. First current $I_{DATA}$ flows through first transistor 26 and second switch transistor 18.

In still another embodiment, a transistor 60 is provided to reset LED 32. Transistor 60 includes a gate 60-2 to receive a voltage signal transmitted over a preceding scan line 12', a first terminal 60-4 coupled to an anode of LED 32, and a second terminal 60-6 coupled to a cathode of LED 32. LED 32 is reset immediately before a corresponding scan line 12 is selected.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pixel device of an electroluminescence device comprising:

a scan line and a data line corresponding to the pixel device;

a voltage signal transmitted over the scan line having a first state and a second state;

a current mirror circuit further comprising a first transistor including a gate, and a second transistor including a gate coupled to the gate of the first transistor;

a first current flowing through the first transistor to the data line being provided in response to the first state of the voltage signal;

a second current proportional to the first current flowing through the second transistor in response to the first state of the voltage;

a light emitting diode connected to the second transistor;

a capacitor being charged to a voltage level in response to the first state of the voltage signal by the first current, and maintaining the second current during the second state of the voltage signal; and a reset circuit for resetting the light emitting diode, comprising a transistor formed across the light emitting diode.

2. The device of claim 1 further comprising a first switch transistor receiving the voltage signal and a second switch transistor receiving the voltage signal.

3. The device of claim 1, the reset circuit further comprising the transistor including a gate coupled to a preceding scan line.

4. The device of claim 1, the first transistor having a channel width/length value times a channel width/length value of the second transistor.

5. The device of claim 1, wherein the first current is a channel width/length value times the second current.

6. The device of claim 1, wherein $$I=(\mu C_{ox}/2)\times(W/L)\times(|V_C|-|V_T|)^2$$

where I is the first current, $\mu$ is the mobility of the carriers, $C_{ox}$ is oxide capacitance, W/L is the channel width/length of the first transistor, $V_c$ is the voltage level and $V_T$ is a threshold voltage of the first transistor.

7. The device of claim 1, the voltage level being maintained for a frame time.

8. An electroluminescence device comprising:

a plurality of scan lines;

a plurality of data lines; and an array of pixels, each of the pixels being disposed near an intersection of one of the scan lines and one of the data lines further comprising:

a voltage signal transmitted over a corresponding scan line having a first state and a second state;

a current mirror circuit further comprising a first transistor including a gate, and a second transistor including a gate coupled to the gate of the first transistor;

a first current flowing through the first transistor to a corresponding data line being provided in response to the first state of the voltage signal;

a second current proportional to the first current flowing through the second transistor in response to the first state of the voltage signal;

a light emitting diode connected to the second transistor;

a capacitor being charged to a voltage level in response to the first state of the voltage signal by the first current, and maintaining the second current during the second state of the voltage signal; and a transistor including a gate coupled to preceding scan line, a first terminal coupled to one end of the light emitting diode, and a second terminal coupled to the other end of the light emitting diode.

9. The device of claim 8, each of the pixels further comprising a first switch transistor having the voltage signal and a second switch transistor receiving the voltage signal.

10. The device of claim 8, the first transistor having a channel width/length value times a channel width/length value of the second transistor.

11. The device of claim 8, wherein $$I=(\mu C_{OX}/2))\times(W/L)\times(|V_C|-V_T|)^2$$

where I is the first current, $\mu$ is the mobility of the carriers, $C_{ox}$ is oxide capacitance, W/L is the channel, width/length of the first transistor, $V_c$ is the voltage level and $V_T$ is a threshold voltage of the first transistor.

12. A method of operating an electroluminescence device comprising:

providing a plurality of scan lines;

providing a plurality of data lines;

providing an array of pixels, each of the pixels being disposed near an intersection of one of the scan lines and one of the data lines;

transmitting a voltage signal, over a scan line corresponding to one of the pixel having a first state and a second state;

providing a current mirror circuit comprising a first transistor further comprising a gate, and a second transistor further comprising a gate coupled to the gate of the first transistor;

flowing a first current through the first transistor to a data line corresponding to the one pixel in response to the first state of the voltage signal;

flowing a second current proportional to the first current through the second transistor in response to the first state of the voltage signal;

connecting a light emitting diode to the second transistor;

charging a capacitor in response to the first state of the voltage signal by the first current;

maintaining the second current during the second state of the voltage signal; and providing each of the pixels with a transistor including a gate coupled to a preceding scan line, a first terminal coupled to one end of the light emitting diode, and a second terminal coupled to the other end of the light emitting diode.

13. The method of claim 12 further comprising providing each of the pixels with a first switch transistor and a second switch transistor.

14. The method of claim 12 further comprising flowing the first current through the first transistor and a second switch transistor to the corresponding data line.

15. The method of claim 12 further comprising resetting the light emitting diode.

16. The method of claim 12 further comprising providing the first transistor with a channel width/length value times a channel width/length value of the second transistor.

* * * * *